US008312745B2

(12) United States Patent
Hasse et al.

(10) Patent No.: US 8,312,745 B2
(45) Date of Patent: Nov. 20, 2012

(54) AUTOMATICALLY CONTROLLED WASHING MACHINE

(75) Inventors: Torsten Hasse, Nauen (DE); Sven Jänicke, Nauen (DE); Uwe Mette, New Bern, NC (US); Ingo Schulze, Panketal (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 590 days.

(21) Appl. No.: 12/600,678

(22) PCT Filed: Jun. 10, 2008

(86) PCT No.: PCT/EP2008/057238

§ 371 (c)(1),
(2), (4) Date: Nov. 18, 2009

(87) PCT Pub. No.: WO2008/155264

PCT Pub. Date: Dec. 24, 2008

(65) Prior Publication Data

US 2010/0147340 A1 Jun. 17, 2010

(30) Foreign Application Priority Data

Jun. 20, 2007 (DE) ..... 10 2007 028 173

(51) Int. Cl.
*D06F 29/00* (2006.01)
*D06F 33/00* (2006.01)
*D06F 35/00* (2006.01)

(52) U.S. Cl. ..... 68/12.18; 68/17 R

(58) Field of Classification Search ..... 68/12.18, 68/17 R
See application file for complete search history.

(56) References Cited

U.S. PATENT DOCUMENTS

| | | | |
|---|---|---|---|
| 4,110,075 | A | 8/1978 | Graf et al. |
| 7,950,088 | B2 | 5/2011 | Dalton |
| 2005/0229652 | A1 | 10/2005 | Kim et al. |
| 2009/0095750 | A1 | 4/2009 | Vitan et al. |

FOREIGN PATENT DOCUMENTS

| | | | |
|---|---|---|---|
| DE | 3234058 | A1 | 3/1984 |
| DE | 3403622 | A1 | 8/1985 |
| DE | 69019666 | T2 | 10/1995 |
| DE | 102006012283 | B3 | 3/2007 |
| EP | 0685587 | A1 | 12/1995 |
| EP | 1063340 | A1 | 12/2000 |
| WO | 02/20893 | A1 | 3/2002 |
| WO | 03/027377 | A1 | 4/2003 |

*Primary Examiner* — Michael Barr
*Assistant Examiner* — Charles W Kling
(74) *Attorney, Agent, or Firm* — James E. Howard; Andre Pallapies

(57) ABSTRACT

An automatically controlled washing machine having a detergent dispensing unit that is arranged in an upper machine space of the washing machine. A drawer is arranged in the detergent dispensing unit and accessible from the front panel of the washing machine. The drawer has at least one chamber for hand-metered addition of washing powder or washing liquid. At least one storage unit in the upper machine space stores liquid or gel-like washing aid. A receptacle unit of the storage unit receives a transportable storage container that contains the liquid or gel-like washing aid and a metering unit automatically meters the liquid or gel-like washing aid. The metering unit is connected to the receptacle unit by a fluid connection and has an outlet opening that opens into a stationary chamber of the detergent dispensing unit.

11 Claims, 2 Drawing Sheets

AUTOMATICALLY CONTROLLED WASHING MACHINE

BACKGROUND OF THE INVENTION

The invention relates to an automatically controlled washing machine, having a detergent dispensing unit disposed in the upper machine space, comprising a drawer accessible from the front having at least one chamber for a hand-metered addition of a detergent or liquid detergent portion, with at least one storage unit for liquid or gel-like washing aids, and a unit each for the automatic metering of each of the stored washing aids being disposed in the upper machine space.

Such a washing machine is known from DE 32 34 058 A1. The discharge line of the storage unit provided with a metering unit ends in a premixing chamber, which is integrated into a circulating line in the lower machine space, in which, when the washing drum is moved, liquid detergent is continuously transported from a lower tub outlet to a slightly higher opening of the tub. Irrespective of this meterable washing aid, manually-metered liquid detergent can be supplied to the laundry treatment process in the known way from a detergent dispensing unit which is likewise accommodated in the upper machine space.

In another known washing machine (DE 34 03 622 A1), a storage space for liquid washing aids is arranged in the pull direction of a drawer behind widely-known detergent chambers, which open upwards to be filled with individual doses of washing powder or liquid detergent and can be flushed from above by means of water jets, said storage space having to be filled again after depletion of said supply. To this end, a filling opening is provided in the cover region of the storage space. With each movement of the detergent drawer into a position for filling the chambers, a certain dose of the stored washing aid is carried from the storage space into a metering chamber by means of a mechanism attached to a drawer and its housing, from which metering chamber it can be transported into the tub of the washing machine during a subsequent washing program by means of water.

In a further known washing machine (DE 100 29 505 A1), irrespective of the detergent dispensing unit integrated on the other side, the upper machine space contains a storage container with a metering pump, which, in each instance after measuring the detergent concentration in the liquid detergent, routes the metered quantity of liquid detergent directly into the tub. At the start of the washing process, provision is made here for approximately 50% of the necessary detergent quantity as powder or liquid from the detergent dispensing unit to be filled together with the inflow water into the tub, preferably according to the above-mentioned measurement, at least a second quantity of detergent is supplied from the storage container.

A washing machine is also known (DE 25 54 592 C1), in which, instead of a conventional detergent dispensing unit in the upper machine space, a series of storage containers are kept for individual components of detergent, from which the control of the washing machine automatically measures the detergent components needed in each instance for the current washing process and supplies them to the washing process at suitable points in time.

Such supplies of detergent or the components thereof and the automatic measurement and supply thereof mean a considerable labor saving for a customer in respect of replenishing washing aids. In some known washing machines, the filling opening for refilling the washing aid is arranged at less accessible points on the washing machine, e.g. directly above the storage space, as a result of which the refilling occasionally required is arduous, since the filling opening of the storage space, if it cannot be closed off, should not be just any size, because of the risk of the washing aid spilling our when moving the drawer. In other known washing machines, an exchange of containers is required, without particular attention being paid to leakages of detergent residues.

BRIEF SUMMARY OF THE INVENTION

The object underlying the invention is to provide a washing machine as cited in the introduction which provides the customer with the choice of manual metering or automatic metering on the one hand, but on the other hand also provides the shortest possible paths for automatically-metered washing aid and low maintenance for the storage unit while avoiding the afore-cited disadvantages.

According to the invention, this object is achieved by the features of the characteristics in claim 1 in that the storage unit is formed from a receptacle unit for washing aids from transportable storage containers which can have a fluid connection to the unit for the automatic metering of the washing aid from the storage container, the outlet opening of the unit ending in a stationary chamber of the detergent dispensing unit. As a result, the units for the supply and metering of a liquid or gel-like detergent can be realized structurally close to one another such that the requirements for the objective can be achieved. At the same time, the customer is in this way freed of direct exposure to or contact with the washing aid.

As a result, in one advantageous development of the invention, of the outlet opening ending in the stationary chamber by means of a metering unit, the liquid washing aid dose can be temporarily stored by the customer without leakage losses and possible contact and can then be largely flushed out of this chamber at a suitable point in time by infed fresh water and can be supplied to the tub of the washing machine in a conventional fashion.

In a further development of the invention, the metering unit is integrated in the receptacle space. Advantageously the receptacle space can then namely be used at the same time as a depot for transportable storage containers and the respective washing aid dose can be transported in a leak-free fashion from the deposited storage container into the stationary chamber. There is in this way no risk of spillage, contamination, residue adhesion and subsequent need for cleaning and the customer will be able to use the inventive washing machine without any problem.

To this end the intake side of the metering unit is preferably provided with a coupling part, which can be connected to a congruent coupling part on the storage container if the storage container is inserted into the receptacle space. The pressure side of the metering unit is permanently connected to a connecting line for the stationary chamber. In this way the customer can remove an empty storage container without damage and replace it with a new, still full storage container. To this end, no flexible lines have to be connected to one another, the openings of which are contaminated prior to connection with washing aid residues. The customer is then best protected from contamination by the washing aid and no such residues are also able to drop into the washing machine and cause damage as a result.

The stationary chamber can advantageously be loaded with fresh water in a manner similar to the chambers which can be moved with drawers from the cover side of the housing. This provides an outstanding way of storing the automatically-metered quantity of washing aid until the control unit of the washing machine allows this chamber to be flushed with fresh water by opening the assigned valve and carries said water into the tub by way of the outlet duct which is common to all chambers.

In accordance with one development of the invention, the storage container(s) is/are arranged in the storage unit below a work top of the washing machine, which can be raised in order to expand the storage of washing aids. This cover plate can form the work top of the washing machine itself or form a flap as part of the work top which is hinged to a cutout of the work top.

On the other hand, the storage unit can instead comprise a filling line, which, for the purpose of refilling washing aid, ends on the front panel of the washing machine, preferably in the region of the control panel. Alternatively, access to the storage unit can be enabled by a door or flap, which is arranged in the front panel and can be opened in order to replace storage containers.

The features of the subclaims can be combined in any combination with one another or with the features of the main claim without departing from the invention.

On the basis of exemplary embodiments shown in the drawings, the invention is described in more detail, in which;

DETAILED DESCRIPTION OF EXEMPLARY EMBODIMENTS OF THE PRESENT INVENTION

Figure 1:
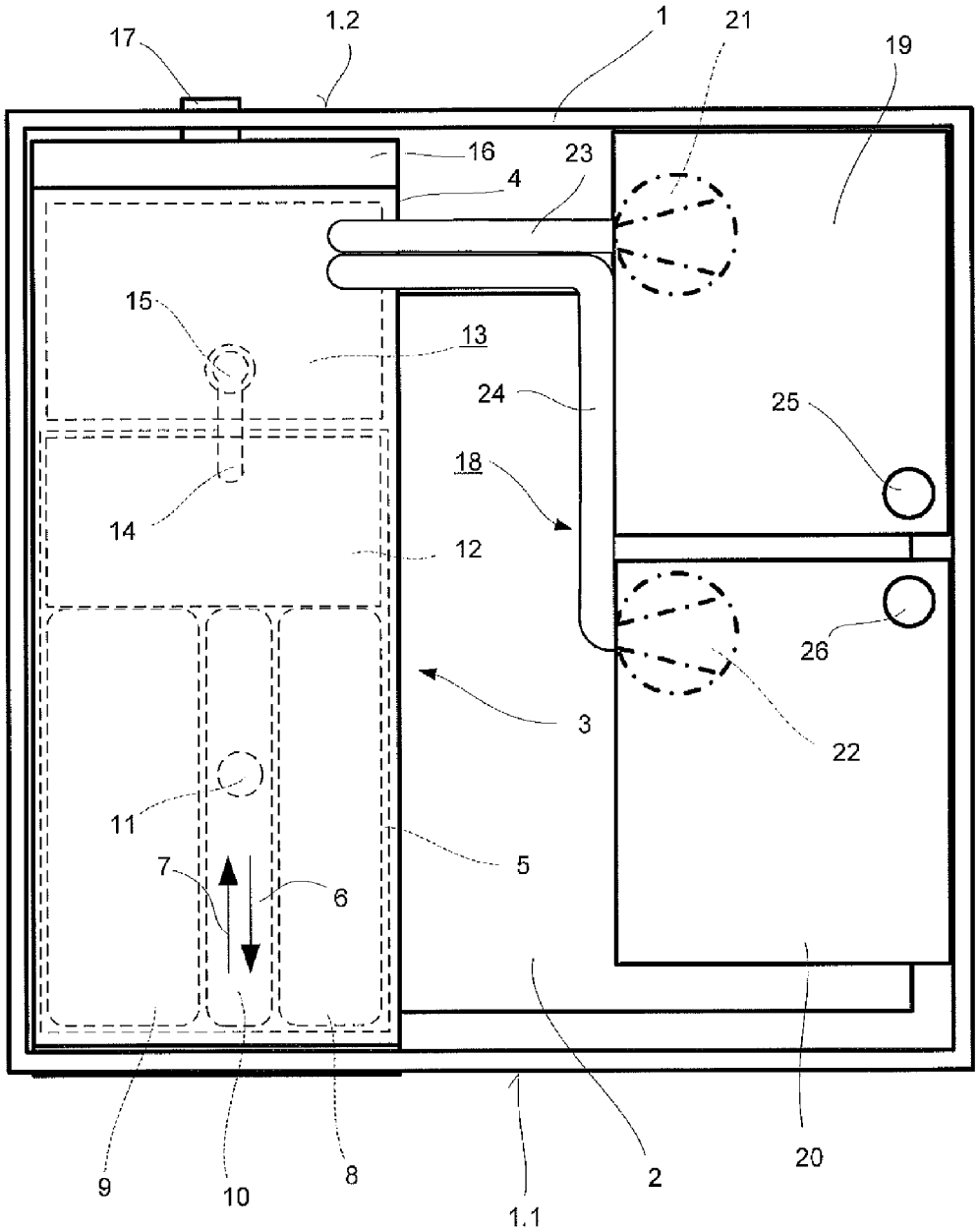
FIG. 1 shows a washing machine in a view from above with an inventively equipped detergent dispensing unit and storage unit and FIG. 2 shows another single storage unit for an inventively equipped washing machine with a unit for automatically metering part of the stored quantity of washing aid.

The housing 1 of the washing machine surrounds a tub 2, which extends so far up in the housing 1 that only the upper lateral space remaining within the housing 1 is available for the detergent dispensing unit 3. The detergent dispensing unit 3 has its own housing box 4, which extends from the front panel 1.1 of the housing 1 to its rear wall 1.2 and in which the drawer 5 is guided in a freely moveable fashion in the pull direction 6 and/or in the insertion direction 7. The drawer 5 has three detergent chambers 8, 9 and 10 open to the top for prewashing detergent (8), main detergent (9) and fabric softener (10). The fabric softener chamber 10 has another siphon 11 (shown schematically). The rear ends of the chambers 8 and 9 as well as the siphon 11 end in a common outlet shaft 12, which carries the mixture of washing aid and water, which can be conveyed from above into the chambers, to the tub 2 in the manner not shown. One or several metering lines 23, 24 from the storage containers 19, 20 washing aids can end in this space (not shown here), which are arranged in the upper space of the washing machine outside the detergent dispensing unit. This solution is advantageous for accommodating storage containers 19, 20 in this manner because no further units have to be provided in order to guide the washing aid doses.

Another solution is shown in FIG. 1. In this figure at least one stationary chamber 13 for dosing a liquid or gel-like washing aid is integrated in the housing 4 of the detergent dispensing unit 3 behind the duct 12 outside the drawer. The chamber and/or chambers 13 are adjusted in terms of their shape and size to the respective space still available behind the chambers 8 to 10 of the drawer 5 and remain fixed in the housing 4 in any event even if the drawer 5 is moved. When a single chamber 13 is accommodated in the housing 4, a dose of up to 500 ml of washing aid can be supplied.

The base of the chamber 13 has an outlet opening 14 with a siphon 15 like the chamber 10 for fabric softener. With the arrangement of several chambers 13, a corresponding number of siphons 15 with outlet openings 14 are naturally to be provided which all end in the same outlet shaft 12.

In the rear region of the housing box 4, a magnetic valve module 16 for loading the chambers 8 and/or 10 and 12 can also be arranged. To load all chambers with fresh water from the magnetic valve associated in each instance, guiding channels and spray nozzles (not shown) are arranged in a known fashion in the cover region of the housing 4 of the detergent dispensing unit 3 so that only the respective chamber is ever subjected to the assigned fresh water stream. The magnetic valve module 16 is to this end supplied with fresh water by way of a central inflow 17 from a mains water supply (not shown).

The free space available on the right side of the upper installation space within the machine housing 1 is filled by a storage unit 18, which can accommodate one or, as shown here, two storage containers 19 and 20. A metering unit 21, 22 is assigned to each storage container, said metering unit essentially including a pump. The intake side of each pump communicates with the interior of the assigned storage container 19, 20 and the pressure side of each pump with an assigned connecting line 23 and/or 24. These lines 23 and 24 end in the chamber 13, which does not cause any problems if the second metering device 22 is only accessed once the dose of the washing aid temporarily stored in the chamber 13 has already been flushed out of the first storage container 19. If by contrast two stationary chambers are provided, each of the connecting lines 23 and 24 can then end in one of the chambers respectively.

Each of the storage containers 19 and 20 has a refilling opening and/or line 25 and/or 26, through which it can be filled, if necessary. To this end, the washing machine has a flap (not shown here) above the storage unit 18, which has to be opened before the filling process. Alternatively, each storage container 19 and 20 can also be provided with a filling line, the filling opening of which is hidden behind a door or flap on the front control panel. This alternative is likewise not shown here.

Figure 2:
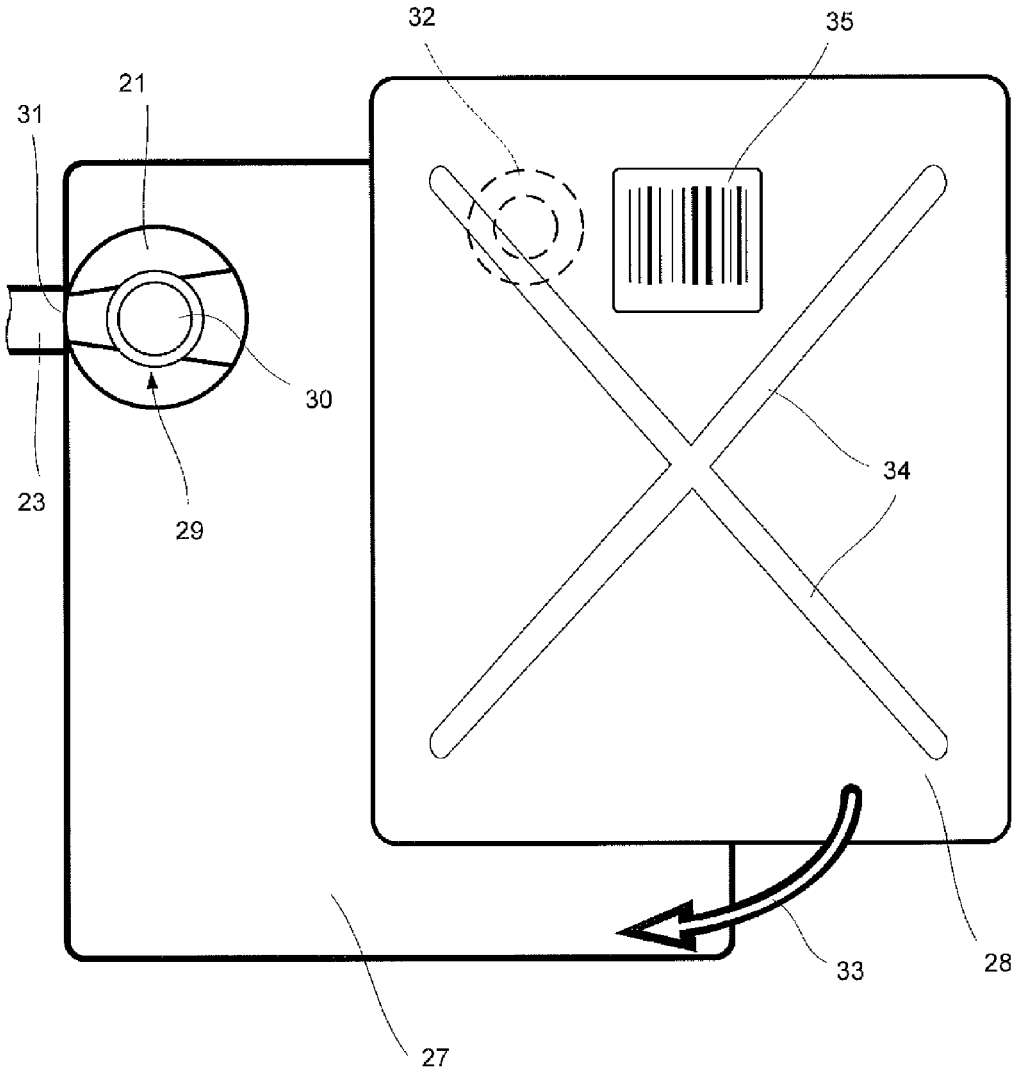

FIG. 2 shows another variant for storing washing aids. To this end, a receptacle unit 27 for a storage container 28 is provided instead of a stationarily integrated storage container 19 and 20 in FIG. 1, said storage container 28 being a transportable and commercially-available storage container and being marketable by a detergent manufacturer. A metering device 21 is arranged in the receptacle unit 27, which forms a box-like space, at the intake side 29 of said metering device of which a coupling part 30 is connected. The metering device 21 is connected with its pressure side 31 to the connecting line 23.

A mating part 32 attached to the base of the storage container 28 adjusts to the coupling part 30 on the intake side, said mating part connecting in a sealed fashion to the coupling part 30 when the storage container 28 is inserted (corresponding to the movement along the arrow 33). The larger surface walls of the storage container 28 have reinforcing beading 34, so that the storage container retains its stability during transport. To allow its content and other information to be read using a machine, an identification label 35 is attached to an easily accessible point.

The structure of the metering devices 21, 22 is not shown in more detail. It can either be embodied according to the prior art known from DE 34 03 622 A1 or in another manner with dispensing devices (magnetic valve, pump, closing slider) for the washing aid storage from the storage container 19 and/or 20 (FIG. 1) or 28 (FIG. 2) in an either pressure-free or pressurized fashion.

The invention claimed is:

1. An automatically controlled washing machine, comprising:

a front panel;

an upper machine space;

a detergent dispensing unit arranged in the upper machine space and having a stationary chamber;

a drawer arranged in the detergent dispensing unit and accessible from the front panel of the washing machine, the drawer having at least one chamber for hand-metered addition of one of a washing powder portion and a washing liquid portion;

at least one storage unit arranged in the upper machine space to store one of liquid washing aid and gel-like washing aid, the storage unit having a receptacle unit to receive a transportable storage container containing the one of the liquid washing aid and the gel-like washing aid; and a metering unit to automatically meter the stored one of the liquid washing aid and the gel-like washing aid, the metering unit connected to the receptacle unit by a fluid connection and having an outlet opening that opens into the stationary chamber of the detergent dispensing unit.

2. The washing machine of claim 1, wherein the metering unit is integrated into the receptacle unit.

3. The washing machine of claim 2, wherein the metering unit has a coupling part on an intake side of the metering unit, wherein the transportable storage container has a congruent coupling part, and wherein the coupling part of the metering unit is connected to the congruent coupling part of the transportable storage container when the transportable storage container is inserted into the metering unit.

4. The washing machine of claim 3, further comprising a connection line to fixedly connect a pressure side of the metering unit with the stationary chamber of the detergent dispensing unit.

5. The washing machine of claim 4, wherein the detergent dispensing unit includes a housing and an outlet shaft; wherein the stationary chamber is integrated into the housing of the detergent dispensing unit and behind the at least one chamber of the drawer; wherein an input side of the stationary chamber communicates with the connection line; and wherein an output side of the stationary chamber freely opens into the outlet shaft of the detergent dispensing unit.

6. The washing machine of claim 5, wherein the housing of the detergent dispensing unit has a cover side, and wherein the stationary chamber of the detergent dispensing unit and the at least one chamber of the drawer are supplied with fresh water from the cover side.

7. The washing machine of claim 6, further comprising a control device to switch on the metering unit and the fresh water supply to the stationary chamber at predetermined points in time.

8. The washing machine of claim 1, further comprising a cover plate that is lifted to replenish the stored one of the liquid washing aid and the gel-like washing aid, wherein the storage unit is arranged below the cover plate.

9. The washing machine of claim 1, wherein the storage unit includes a filling line that ends at the front panel of the washing machine to replenish the one of the liquid washing aid and gel-like washing aid.

10. The washing machine of claim 9, wherein the front panel includes a control panel, and wherein the filling line ends in a predetermined area of the control panel.

11. The washing machine of 1, wherein the front panel includes one of a door and a flap; wherein the storage unit is arranged behind the one of the door and the flap; and wherein the one of the door and the flap is opened to exchange the transportable storage container.

* * * * *